US009997098B2

(12) United States Patent
Byun

(10) Patent No.: US 9,997,098 B2
(45) Date of Patent: Jun. 12, 2018

(54) ORGANIC LIGHT EMITTING DIODE DISPLAY DEVICE AND DRIVING METHOD OF THE SAME

(71) Applicant: LG Display Co., Ltd., Seoul (KR)

(72) Inventor: Min-Chul Byun, Goyang-si (KR)

(73) Assignee: LG Display Co., LTD, Seoul (KR)

( * ) Notice: Subject to any disclaimer, the term of this patent is extended or adjusted under 35 U.S.C. 154(b) by 0 days. days.

(21) Appl. No.: 15/248,880

(22) Filed: Aug. 26, 2016

(65) Prior Publication Data

US 2017/0061852 A1 Mar. 2, 2017

(30) Foreign Application Priority Data

Aug. 31, 2015 (KR) ..... 10-2015-0122626

(51) Int. Cl.
*G09G 3/20* (2006.01)
*G09G 3/3275* (2016.01)

(52) U.S. Cl.
CPC ..... *G09G 3/2055* (2013.01); *G09G 3/3275* (2013.01); *G09G 2310/027* (2013.01); *G09G 2320/0257* (2013.01)

(58) Field of Classification Search
CPC ..... G09G 3/3275; G09G 2320/0257; G09G 2310/027
See application file for complete search history.

(56) References Cited

U.S. PATENT DOCUMENTS

2007/0126757 A1* 6/2007 Itoh ..... G09G 3/3233 345/690
2007/0229428 A1* 10/2007 Nakagawa ..... G09G 3/3233 345/92
2010/0060554 A1* 3/2010 Koh ..... G09G 3/3225 345/77
2016/0117973 A1* 4/2016 Lee ..... G09G 3/2051 345/691

* cited by examiner

*Primary Examiner* — Sahlu Okebato
(74) *Attorney, Agent, or Firm* — Fenwick & West LLP

(57) ABSTRACT

An organic light emitting diode display device includes a display panel including pixels that each include an organic light emitting diode; a logo area detection unit detecting a logo area of the display panel; and a data signal modulation unit applying a first data signal to at least one pixel in the logo area during at least one frame and applying a second data signal to the at least one pixel in the logo area during another frame, wherein a first brightness corresponding to the first data signal is higher than a reference brightness of the at least one pixel in the logo area, a second brightness corresponding to the second data signal is lower than the reference brightness, and an average of the first brightness and the second brightness every frame is equal to the reference.

15 Claims, 6 Drawing Sheets

ORGANIC LIGHT EMITTING DIODE DISPLAY DEVICE AND DRIVING METHOD OF THE SAME

CROSS-REFERENCE TO RELATED APPLICATION

The present application claims priority under U.S.C § 119(a) to Korean Patent Application No. 10-2015-0122626 filed in the Republic of Korea on Aug. 31, 2015, which is hereby incorporated by reference in its entirety.

BACKGROUND

Field of the Disclosure

The present disclosure relates to an organic light emitting diode display device, and more particularly, to an organic light emitting diode display device and a driving method of the same capable of preventing an afterimage seen in a logo area.

Discussion of the Related Art

Flat panel display devices, such as plasma display panel (PDP) devices, liquid crystal display (LCD) devices and organic light emitting diode (OLED) display devices, have been widely researched and used.

Among these flat panel display devices, since an OLED display device is self-luminous and does not require a backlight unit used for a LCD device, the OLED display device has a relatively thin profile and light weight.

In addition, the OLED display device has advantages of wide viewing angles, high contrast ratio and low power consumption compared to the LCD device. The OLED device is driven by low voltages of direct current (DC) and is used in a wide range of temperatures. The OLED display device has a fast response time and is strong against the external impacts because its components are solids.

Particularly, since manufacturing processes of the OLED display device are simple, the cost of production is considerably lowered in comparison with the LCD device.

FIG. 1 is a graph showing brightness of one pixel in a logo area of a related art OLED display device during one frame.

In FIG. 1, the same data is continuously provided to a pixel in a logo area of the related art OLED display device for certain frames, for example, for first, second, third and fourth frames f1, f2, f3 and f4, and an organic light emitting diode in the pixel emits light with the same brightness La. In this case, an afterimage occurs.

Specially, if a logo is continuously outputted in a certain area for a long time, an organic light emitting diode in the area where the logo is outputted deteriorates. Thus, although the logo is not outputted, the afterimage of the logo remains in the area where the logo was outputted.

To prevent the afterimage of the logo, a method has been used in which a location of the logo area is found by comparing image data each frame and then brightness in the logo area is lowered.

However, the method of lowering the brightness in the logo area causes a problem that an image quality in the logo area is also lowered.

Moreover, the brightness in the logo area is lowered without consideration of brightness around the logo area. Thus, when the brightness around the logo area is relatively high, the brightness in the logo area is relatively further lowly viewed.

Furthermore, since the afterimage of the logo is caused by the deterioration of the organic light emitting diode, the method of lowering only the brightness in the logo area cannot solve a basic cause of the afterimage.

SUMMARY

Accordingly, the present disclosure is directed to an OLED display device that substantially obviates one or more of the problems due to limitations and disadvantages of the related art.

An object of the present disclosure is to provide an OLED display device that prevents an afterimage from occurring in a logo area.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present disclosure, as embodied and broadly described herein, there is provided an organic light emitting diode display device includes a display panel including pixels, each of which includes an organic light emitting diode and is arranged at a crossing portion of a gate line and a data line; a logo area detection unit detecting a logo area of the display panel; and a data signal modulation unit applying a first data signal to at least one pixel in the logo area during at least one frame of first to nth frames (n is an integer more than 2) and applying a second data signal to the at least one pixel in the logo area during at least one of the first to nth frames excluding the at least one frame, wherein a first brightness corresponding to the first data signal is higher than a reference brightness of the at least one pixel in the logo area, a second brightness corresponding to the second data signal is lower than the reference brightness, and an average of the first brightness and the second brightness every frame is equal to the reference brightness.

In another aspect, a driving method of an organic light emitting diode display device includes detecting a logo area of a display panel including pixels, each of which includes an organic light emitting diode and is arranged at a crossing portion of a gate line and a data line; and applying a first data signal to at least one pixel in the logo area during at least one frame of first to nth frames (n is an integer more than 2) and applying a second data signal to the at least one pixel in the logo area during at least one of the first to nth frames excluding the at least one frame, wherein a first brightness corresponding to the first data signal is higher than a reference brightness of the at least one pixel in the logo area, a second brightness corresponding to the second data signal is lower than the reference brightness, and an average of the first brightness and the second brightness every frame is equal to the reference brightness.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Reference will now be made in detail to the embodiment of the disclosure, an example of which is illustrated in the accompanying drawings.

Figure 1:
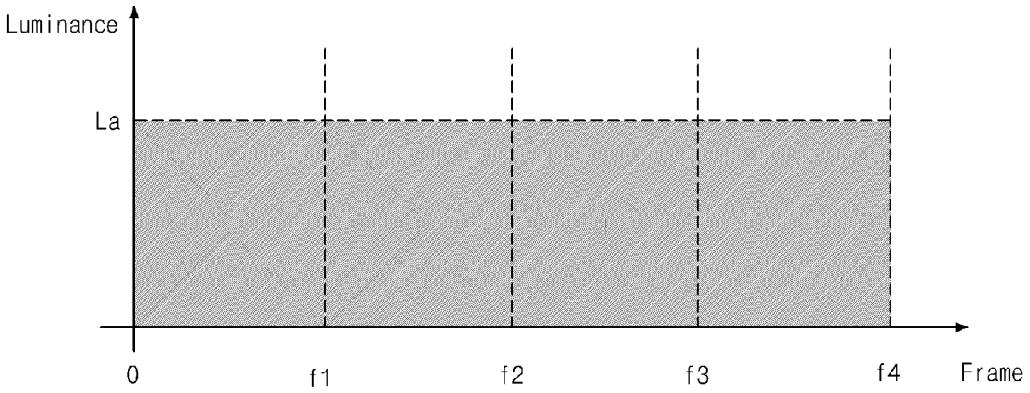
FIG. 1 is a graph showing brightness of one pixel in a logo area of a related art OLED display device during one frame.
Figure 2:
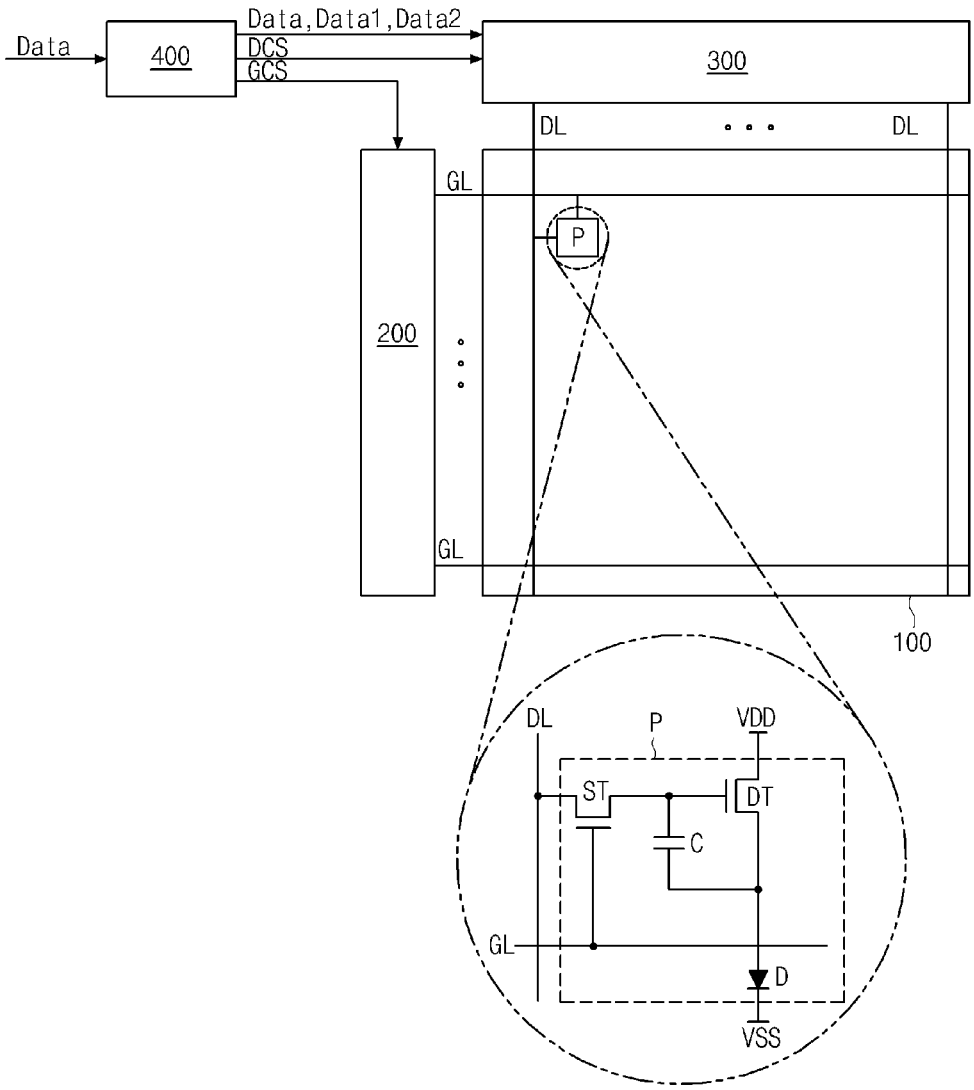
FIG. 2 is a view of an OLED display device according to an embodiment of the present disclosure.

FIG. 2 is a view of an OLED display device according to an embodiment of the present disclosure.

In FIG. 2, the OLED display device according to the embodiment of the present disclosure includes a display panel 100, a gate driving unit 200, a data driving unit 300, and a timing controller 400. The display panel 100 includes a plurality of pixels P, and each pixel P is connected to gate lines GL and data lines DL at each crossing point of the gate lines GL and the data lines DL. The gate driving unit 200 outputs gate signals to the gate lines GL, and the data driving unit 300 outputs analog data signals to the data lines DL.

More particularly, the timing controller 400 generates a gate control signal GCS controlling the operation timing of the gate driving unit 200 and a data control signal DCS controlling the operation timing of the data driving unit 300 using a vertical synchronization signal Vsync, a horizontal synchronization signal Hsync, and a data enable signal DE inputted from the external system and outputs the gate control signal GCS and the data control signal DCS to the gate driving unit 200 and the data driving unit 300, respectively.

In addition, an image data Data is inputted from the external system to the timing controller 400. The timing controller 400 outputs the image data Data to the data driving unit 300 for the pixels P in an area excluding a logo area, which may be referred to as a non logo area, without modulating the image data Data. The timing controller 400 modulates the image data Data and outputs first and second data signals Data1 and Datat2 to the data driving unit 300 for the pixels P in the logo area.

Each pixel P includes an organic light emitting diode D, a switching thin film transistor ST, and a driving thin film transistor DT. The switching thin film transistor ST and the driving thin film transistor DT are connected to the gate and data lines GL and DL and control the organic light emitting diode D.

In detail, a drain electrode of the driving thin film transistor DT is connected to a first power supply VDD, an anode electrode of the organic light emitting diode D is connected to a source electrode of the driving thin film transistor DT, a cathode electrode of the organic light emitting diode D is connected to a second power supply VSS. The organic light emitting diode D emits light with brightness corresponding to currents supplied from the driving thin film transistor DT. A gate electrode of the switching thin film transistor ST is connected to the gate line GL, and a source electrode of the switching thin film transistor ST is connected to a gate electrode of the driving thin film transistor DT. The switching thin film transistor ST turns on by a gate signal applied through the gate line GL and supplies a data signal applied from the data line DL to the driving thin film transistor DT.

Additionally, a capacitor C has a first electrode connected to the gate electrode of the driving thin film transistor DT and a second electrode connected to the anode electrode of the organic light emitting diode D. The capacitor C maintains the data signal supplied to the driving thin film transistor DT during a frame.

Figure 3:
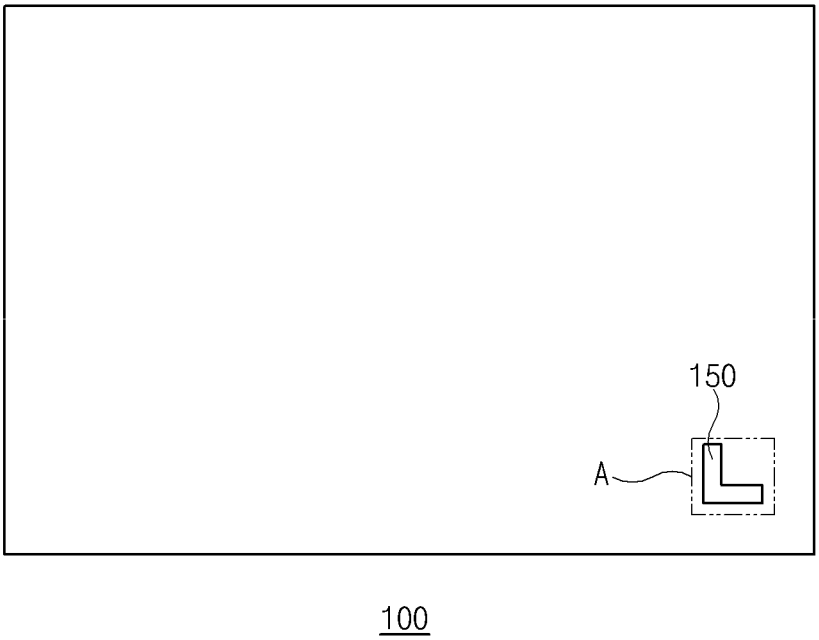
FIG. 3 is a view schematically illustrating the logo area of the display panel of FIG. 2 according to an embodiment of the present disclosure.
Figure 4:
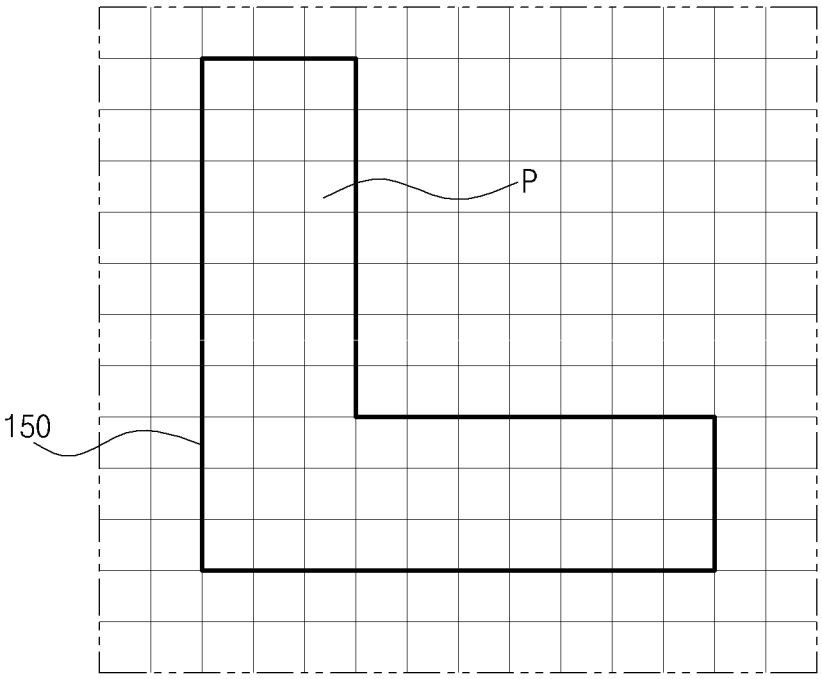
FIG. 4 is an enlarged view of the A area of FIG. 3 according to an embodiment of the present disclosure.

FIG. 3 is a view schematically illustrating the logo area of the display panel of FIG. 2 according to one embodiment, and FIG. 4 is an enlarged view of the A area of FIG. 3 according to one embodiment.

In FIG. 3 and FIG. 4, the display panel 100 of the OLED display device according to the embodiment of the present disclosure includes the logo area 150.

In addition, the logo area 150 includes a plurality of pixels P, and each pixel P includes an organic light emitting diode D of FIG. 2.

Figure 5:
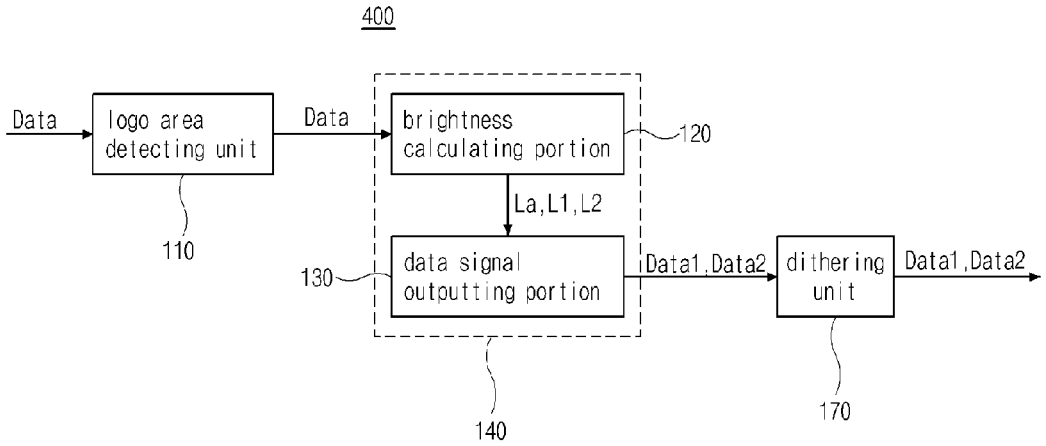
FIG. 5 is a block diagram of the timing controller of the OLED display device according to the embodiment of the present disclosure.
Figure 6:
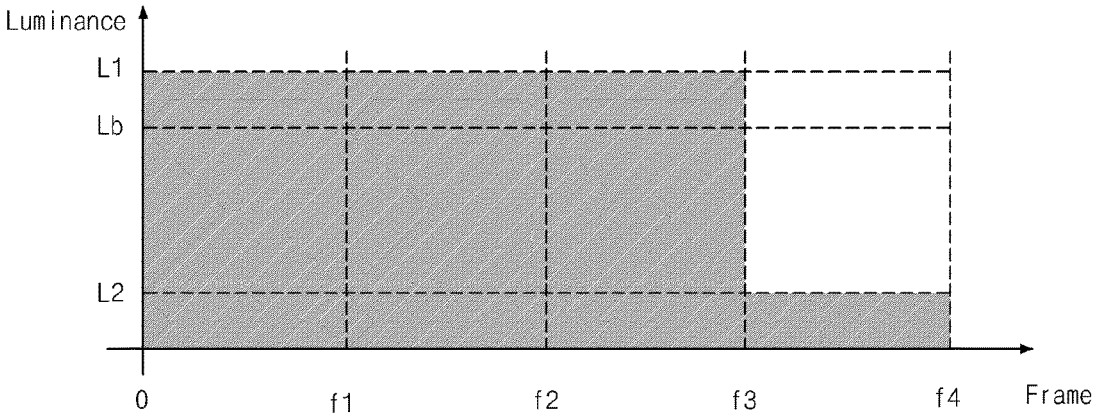
FIG. 6 is a graph showing the brightness of a pixel in the logo area of the OLED display device during a frame according to the embodiment of the present disclosure.
Figure 7:
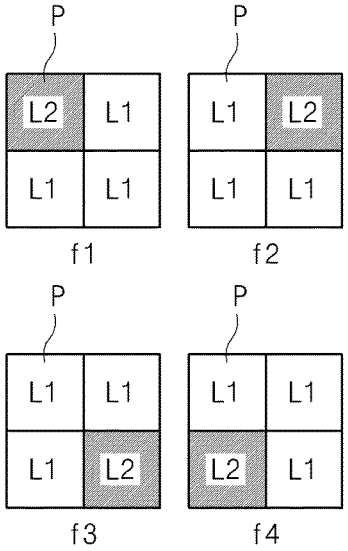
FIG. 7 is a view for explaining a dithering method of the pixel in the logo area of the OLED display device according to the embodiment of the present disclosure.

FIG. 5 is a block diagram of the timing controller 400 of the OLED display device according to the embodiment of the present disclosure. FIG. 6 is a graph showing the brightness of a pixel in the logo area of the OLED display device according to the embodiment of the present disclosure during a frame. FIG. 7 is a view for explaining a dithering method of the pixel in the logo area of the OLED display device according to the embodiment of the present disclosure.

In FIG. 5, the timing controller 400 of the OLED display device according to the embodiment of the present disclosure includes a logo area detecting unit 110 and a data signal modulation unit 140.

In addition, the data signal modulation unit 140 includes a brightness calculating portion 120 and a data signal outputting portion 130.

Specifically, the logo area detecting unit 110 detects the logo area 150 by comparing a variation of the image data Data inputted from the external system every frame and outputs a location of the logo area 150 to the brightness calculating portion 120.

Here, the brightness calculating portion 120 calculates a reference brightness Lb, a first brightness L1 and a second brightness L2.

In addition, the data signal modulation unit 140 applies the modulated first data signal Data1 to one pixel P of the logo area 150 during at least one frame of first to nth frames (n is an integer larger than 2), that is, at lest one selected frame and applies the modulated second data signal Data2 to the pixel P of the logo area 150 during at least one of the first to nth frames excluding the at least one frame, i.e., at least one non-selected frame.

For example, as shown in FIG. 6, the data signal modulation unit 140 applies the first data signal Data1 corresponding to the first brightness L1 during the first to third frames f1 to f3 of the first, second, third and fourth frames f1, f2, f3 and f4 and applies the second data signal Data2 corresponding to the second brightness L2 during the fourth frame f4.

Here, the first brightness L1 corresponding to the first data signal Data1 is higher than the reference brightness Lb of the pixel P in the logo area 150 (L1>Lb), the second brightness L2 corresponding to the second data signal Data2 is lower than the reference brightness Lb of the pixel P in the logo area 150 (L2<Lb), and a frame average of the first brightness L1 and the second brightness L2 each frame is equal to the reference brightness Lb of the pixel P in the logo area 150.

At this time, the reference brightness Lb may be determined to have the same value as a brightness La of the pixel in the logo area of the related art OLED display device (Lb=La).

According to this, the frame average of the first brightness L1 and second brightness L2 of the pixel P in the logo area 150 of the OLED display device according to the embodiment of the present disclosure, that is, the reference brightness Lb is equal to the brightness La of the pixel in the logo area of the related art OLED display device, and thus the image quality and visibility are prevented from being lowered.

At the same time, the first and second data signals Data1 and Data2, which are different from each other, are applied to the pixel P in the logo area 150 every predetermined frames. Therefore, the afterimage of the logo area 150, which is caused by the deterioration of the organic light emitting diode D at the pixel P in the logo area 150, is prevented.

Additionally, the timing controller 400 of the OLED display device according to the embodiment of the present disclosure further includes a dithering unit 170.

In detail, the dithering unit 170 receives the first and second data signals Data1 and Data2 from the data signal outputting portion 130 of the data signal modulation unit 140 and then the dithering unit 170 applies the first data signal Data1 to at least one pixel P in the logo area 150, that is, at least one selected pixel P, and applies the second data signal Data2 to at least one of the pixels P excluding the at least one pixel P in the logo area 150, i.e., at least one non-selected pixel P.

At this time, the location of the pixel P receiving the first data signal Data1 or the location of the pixel P receiving the second data signal Data2 is changed every frame during the first to nth frames (n is an integer larger than 2).

For instance, as shown in FIG. 7, the first data signal Data1 is applied to three pixels P in the logo area 150 having a pixel arrangement of two lines and two rows, and the second data signal Data2 is applied to one of the pixels P excluding the three pixels P, that is, the other pixel P in the logo area 150.

At this time, the location of the pixel P receiving the second data signal Data2 is changed during the first to fourth frames f1 to f4.

Accordingly, the different data signals Data1 and Data2 are applied to the pixels P in the logo area 150 every frame, and it is prevented that the flicker occurs because the brightness L1 and L2 of the logo area 150 is changed every frame.

Moreover, the pixel P in the logo area 150 includes first, second and third sub-pixels R, G and B.

At this time, the data signal output portion 130 outputs the first and second data signals Data1 and Data2 when the first brightness L1 is equal to or less than the predetermined maximum brightness Lm (L1≤Lm) and the first data signal Data1 of each of the first, second and third sub-pixels R, G and B is equal to or less than a maximum gray level. The data signal output portion 130 decreases a gray level of the first data signal Data1 and increases a gray level of the second data signal Data2 when the first brightness L1 is more than the maximum brightness (L1>Lm) or the first data signal Data1 of at least one of the first, second and third sub-pixels R, G and B is more than the maximum gray level.

Figure 8:
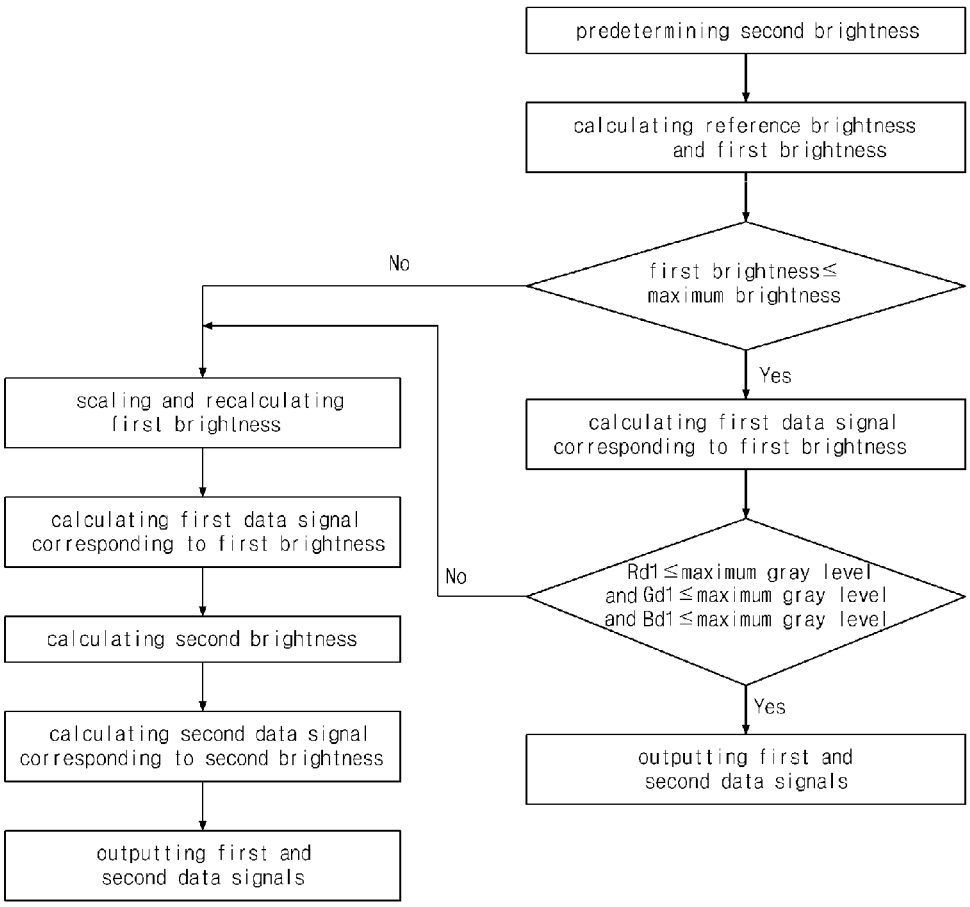
FIG. 8 is a flow chart for explaining an outputting method of first and second data signals of the data signal modulation unit of the present disclosure.

FIG. 8 is a flow chart for explaining an outputting method of first and second data signals of the data signal modulation unit of the present disclosure.

In FIG. 8, firstly, the second brightness L2 and the second data signal Data2 are predetermined 801, and the reference brightness Lb and the first brightness L1 are calculated 803.

Next, the calculated first brightness L1 is compared 805 with the maximum brightness Lm, and if the first brightness L1 is equal to or less than the maximum brightness Lm (L1≤Lm), the first data signal Data1(Rd1, Gd1, Bd1) of each of the first, second and third sub-pixels R, G and B corresponding to the first brightness L1 is calculated 807.

Then, if the calculated first data signal Data1(Rd1, Gd1, Bd1) of each of the first, second and third sub-pixels R, G and B is equal to or less than the maximum gray level 809, the first and second data signals Data1 and Data2 are outputted 811.

At this time, the first brightness L1 is scaled and recalculated 813 if the first brightness L1 is more than the maximum brightness (L1>Lm) by comparing the calculated first brightness L1 and the maximum brightness Lm or the calculated first data signal Data1(Rd1, Gd1, Bd1) of at least one of the first, second, and third sub-pixels R, G and B is more than the maximum gray level.

Next, the first data signal Data1 corresponding to the first brightness L1 is calculated 815, and the second data signal Data2 corresponding to the second brightness L2 is calculated 819 after recalculating the second brightness L2 by the scaled first brightness L1 817.

Then, the calculated first and second data signals Data1 and Data2 are outputted 821.

Hereinafter, a method of calculating the first and second data signals Data1 and Data2 will be described with reference to the following equations.

Firstly, the second brightness L2 and the second data signal Data2 are predetermined as 0 or an arbitrary value.

Next, the reference brightness Lb of the pixel P in the logo area 150 is calculated by the following equation 1.

At this time, the reference brightness Lb is calculated by receiving the reference data from the external system.

$$Lb=LR+LG+LB$$

$$LR=Lm*LR(\text{White})*[(R\text{Logo}/255)\hat{}\text{Gamma}]$$

$$LG=Lm*LG(\text{White})*[(G\text{Logo}/255)\hat{}\text{Gamma}]$$

$$LB=Lm*LB(\text{White})*[(B\text{Logo}/255)\hat{}\text{Gamma}] \quad \text{[equation 1]}$$

Here, LR, LG and LB are the reference brightness of the first, second and third sub-pixels R, G and B, respectively. Lm is the predetermined maximum brightness. LR(White), LG(White) and LB(White) are the brightness rate of the first, second and third sub-pixels R, G and B of white. RLogo, GLogo and BLogo are the data signal value of the first, second and third sub-pixels R, G and B. Gamma is also referred to as gamma correction or gamma encoding and is a value determining a relationship between an input gray level and an output luminance. For example, Gamma is 2.2. Alternatively, to give prominence to high gray levels rather than low gray levels, Gamma may be 2.4 to 2.6.

Meanwhile, 255 is the maximum gray level when the image data is 8 bit and 256 gray levels are used. If the number of bit is changed, the maximum gray level is also changed. That is, when the image data is 10 bit and 1024 gray levels are used, the maximum gray level is 1023.

Next, the first brightness L1 of the pixel P in the logo area 150 is calculated by the following equation 2.

$$L1=Lb/Rn$$

$$Rn=n1/n \quad \text{[equation 2]}$$

Here, n is the number of frames, and n1 is the number of frames showing the first brightness L1.

At this time, if the first brightness is equal to or less than the maximum brightness Lm (L1≤Lm), the values of the first data signal Data1(Rd1, Gd1, Bd1) of the first, second and third sub-pixels R, G and B are determined by the following equation 3.

$$Rd1=[((L1*LR(\text{Logo}))/(Lm*LR(\text{White})))^{(1/\text{Gamma})}]*255$$

$$Gd1=[((L1*LG(\text{Logo}))/(Lm*LG(\text{White})))^{(1/\text{Gamma})}]*255$$

$$Bd1=[((L1*LB(\text{Logo}))/(Lm*LB(\text{White})))^{(1/\text{Gamma})}]*255 \quad \text{[equation 3]}$$

Here, LR(Logo)=LR/(LR+LG+LB), LG(Logo)=LG/(LR+LG+LB), and LB(Logo)=LB/(LR+LG+LB).

At this time, if the first brightness L1 is more than the maximum brightness (L1>Lm) or the value of the calculated first data signal Data1(Rd1, Gd1, Bd1) of at least one of the first, second and third sub-pixels R, G and B is more than the maximum gray level, the first data signal Data1(Rd1, Gd1, Bd1) of the first, second and third sub-pixels R, G and B is determined by the following equation 4.

$$Rd1=[((L1*LR(\text{Logo})/\text{Scale})/(Lm*LR(\text{White})))^{(1/\text{Gamma})}]*255$$

$$Gd1=[((L1*LG(\text{Logo})/\text{Scale})/(Lm*LG(\text{White})))^{(1/\text{Gamma})}]*255$$

$$Bd1=[((L1*LB(\text{Logo})/\text{Scale})/(Lm*LB(\text{White})))^{(1/\text{Gamma})}]*255 \quad \text{[equation 4]}$$

Here, Scale=max[(L1*LR(Logo))/(Lm*LR(White)), (L1*LG(Logo))/(Lm*LG(White)), (L1*LB(Logo))/(Lm*LB(White))].

Next, the values of the predetermined second data signal Data2(Rd2, Gd2, Bd2) of the first, second and third sub-pixels R, G and B are recalculated by the following equation 5 such that the frame average of the first and second brightnesses L1 and L2 is the same as the reference brightness Lb.

$$Rd2=[((L2*LR(\text{Logo}))/(Lm*LR(\text{White})))^{(1/\text{Gamma})}]*255$$

$$Gd2=[((L2*LG(\text{Logo}))/(Lm*LG(\text{White})))^{(1/\text{Gamma})}]*255$$

$$Bd2=[((L2*LB(\text{Logo}))/(Lm*LB(\text{White})))^{(1/\text{Gamma})}]*255 \quad \text{[equation 5]}$$

Here, L2=(Lb−(L1*Rn))/(1−Rn).

Hereinafter, a driving method of the OLED display device according to the embodiment of the present disclosure will be described.

The driving method of the OLED display device according to the embodiment of the present disclosure includes a step of detecting the logo area 150 and a step of applying the modulated first and second data signals Data1 and Data2 to at least one pixel P in the logo area 150.

Particularly, the step of detecting the logo area 150 includes detecting the logo area 150 of the display panel 100 including the pixels P, each of which is arranged at each crossing portion of the data lines DL and the gate lines GL and includes the organic light emitting diode D.

In addition, the step of applying the modulated first and second data signals Data1 and Data2 to the at least one pixel P in the logo area 150 includes applying the modulated first data signal Data1 to the at least one pixel P in the logo area 150 during the at least one selected frame of the first to nth frames (n is an integer larger than 2) and applying the modulated second data signal Data2 to the at least one pixel P in the logo area 150 during the at least one non-selected frame of the first to nth frames.

At this time, the first brightness L1 corresponding to the first data signal Data1 is higher than the reference brightness Lb of the at least one pixel P in the logo area 150 (L1>Lb), the second brightness L2 corresponding to the second data signal Data2 is lower than the reference brightness Lb (L2<Lb), and the frame average of the first brightness L1 and second brightness L2 each frame is equal to the reference brightness Lb.

According to the driving method of the OLED display device of the present disclosure, the frame average of the first brightness L1 and second brightness L2 of the at least one pixel P in the logo area 150, that is, the reference brightness Lb is equal to the brightness La of the pixel in the logo area of the related art OLED display device, and thus the image quality and visibility are prevented from being lowered.

At the same time, the first and second data signals Data1 and Data2, which are different from each other, are alternately applied to the at least one pixel P in the logo area 150 every predetermined frames. Therefore, the afterimage of the logo area 150, which is caused by the deterioration of the organic light emitting diode D at the at least one pixel P in the logo area 150, is prevented.

Moreover, the first data signal Data1 is applied to the at least one selected pixel P of in the logo area 150 and the second data signal Data2 is applied to the at least one non-selected pixel P in the logo area 150.

At this time, the location of the pixel P receiving the first data signal Data1 or the location of the pixel P receiving the second data signal Data2 is changed every frame during the first to nth frames (n is an integer larger than 2).

Accordingly, the different data signals Data1 and Data2 are applied to the pixels P in the logo area 150 every frame, and it is prevented that the flicker occurs because the brightness L1 and L2 of the logo area 150 is changed every frame.

In addition, each pixel P in the logo area 150 includes first, second and third sub-pixels R, G and B.

At this time, the first and second data signals Data1 and Data2 are outputted when the first brightness L1 is equal to or less than the predetermined maximum brightness Lm (L1≤Lm) and the first data signal Data1 of each of the first, second and third sub-pixels R, G and B is equal to or less than the maximum gray level. The gray level of the first data signal Data1 is decreased and the gray level of the second data signal Data2 is increased when the first brightness L1 is more than the maximum brightness (L1>Lm) or the first data signal Data1 of at least one of the first, second and third sub-pixels R, G and B is more than the maximum gray level.

In the present disclosure, the data signal applied to the pixel in the logo area is modulated and dividedly applied each frame, and there is an effect to prevent the afterimage of the logo area, which is caused by the deterioration of the organic light emitting diode.

In addition, the different data signals are applied to the pixels in the logo area every frame, and there is another effect to prevent the flicker, which is caused by the different brightness of the logo area every frame.

It will be apparent to those skilled in the art that various modifications and variations can be made in a display device of the present disclosure without departing from the sprit or scope of the invention. Thus, it is intended that the present disclosure covers the modifications and variations of this invention provided they come within the scope of the appended claims and their equivalents.

What is claimed is:

1. An organic light emitting diode display device comprising:

a display panel including pixels, each of which includes an organic light emitting diode and is arranged at a crossing portion of a gate line and a data line;

a logo area detecting unit detecting a logo area of the display panel; and a data signal modulation unit applying a first data signal to at least one pixel in the logo area during at least one frame of first to nth frames (n is an integer more than 2) and applying a second data signal to the at least one pixel in the logo area during at least one of the first to nth frames excluding the at least one frame, wherein a first brightness corresponding to the first data signal is higher than a reference brightness of the at least one pixel in the logo area, a second brightness corresponding to the second data signal is lower than the reference brightness, and an average of the first brightness and the second brightness every frame is equal to the reference brightness, and wherein the first brightness is calculated by the following equation:

$$L1=Lb/Rn$$

$$Rn=n1/n$$

wherein, L1 is the first brightness, Lb is the reference brightness, n is the number of frames, and n1 is the number of frames showing the first brightness.

2. The organic light emitting diode display device of claim 1, further comprising a dithering unit applying the first data signal to the at least one pixel in the logo area and applying the second data signal to at least one of the pixels excluding the at least one pixel in the logo area.

3. The organic light emitting diode display device of claim 2, wherein the dithering unit changes a location of the at least one pixel receiving the first data signal or a location of the pixel receiving the second data signal every frame.

4. The organic light emitting diode display device of claim 3, wherein the data signal modulation unit includes a brightness calculating portion calculating the reference brightness, the first brightness and the second brightness.

5. The organic light emitting diode display device of claim 4, the reference brightness is calculated by the following equation:

$$Lb=LR+LG+LB$$

$$LR=Lm*LR(\text{White})*[(R\text{Logo}/255)\hat{}\text{Gamma}]$$

$$LG=Lm*LG(\text{White})*[(G\text{Logo}/255)\hat{}\text{Gamma}]$$

$$LB=Lm*LB(\text{White})*[(B\text{Logo}/255)\hat{}\text{Gamma}]$$

wherein, Lb is the reference brightness, LR, LG and LB are the reference brightness of the first, second and third sub-pixels, respectively, Lm is the predetermined maximum brightness, LR(White), LG(White) and LB(White) are the brightness rate of the first, second and third sub-pixels of white, and RLogo, GLogo and BLogo are the data signal value of the first, second and third sub-pixels.

6. The organic light emitting diode display device of claim 1, wherein each pixel in the logo area includes first, second and third sub-pixels, and wherein the data signal modulation unit further includes a data signal outputting portion outputting the first and second data signals when the first brightness is equal to or less than a predetermined maximum brightness and the first data signal of each of the first, second and third sub-pixels is equal to or less than a maximum gray level.

7. The organic light emitting diode display device of claim 6, wherein the data signal outputting portion decreases a gray level of the first data signal and increases a gray level of the second data signal when the first brightness is more than the maximum brightness or the first data signal of at least one of the first, second and third sub-pixels is more than the maximum gray level.

8. The organic light emitting diode display device of claim 4, the second brightness is calculated by the following equation:

$$L2=(Lb-(L1*Rn))/(1-Rn)$$

wherein, L2 is the second brightness.

9. A driving method of an organic light emitting diode display device, comprising:

detecting a logo area of a display panel including pixels, each of which includes an organic light emitting diode and is arranged at a crossing portion of a gate line and a data line; and applying a first data signal to at least one pixel in the logo area during at least one frame of first to nth frames (n is an integer more than 2) and applying a second data signal to the at least one pixel in the logo area during at least one of the first to nth frames excluding the at least one frame, wherein a first brightness corresponding to the first data signal is higher than a reference brightness of the at least one pixel in the logo area, a second brightness corresponding to the second data signal is lower than the reference brightness, and an average of the first brightness and the second brightness every frame is equal to the reference brightness, and wherein the first brightness is calculated by the following equation:

$$L1=Lb/Rn$$

$$Rn=n1/n$$

wherein, L1 is the first brightness, Lb is the reference brightness, n is the number of frames, and n1 is the number of frames showing the first brightness.

10. The driving method of claim 9, wherein the first data signal is applied to the at least one pixel in the logo area and the second data signal is applied to at least one of the pixels excluding the at least one pixel in the logo area every frame.

11. The driving method of claim 10, wherein a location of the at least one pixel receiving the first data signal or a location of the pixel receiving the second data signal is changed every frame.

12. The driving method of claim 9, further comprising:

calculating the reference brightness by the following equation:

$$Lb=LR+LG+LB$$

$$LR=Lm*LR(\text{White})*[(R\text{Logo}/255)\hat{}\text{Gamma}]$$

$$LG=Lm*LG(\text{White})*[(G\text{Logo}/255)\hat{}\text{Gamma}]$$

$$LB=Lm*LB(\text{White})*[(B\text{Logo}/255)\hat{}\text{Gamma}]$$

wherein, Lb is the reference brightness, LR, LG and LB are the reference brightness of the first, second and third sub-pixels, respectively, Lm is the predetermined maximum brightness, LR(White), LG(White) and LB(White) are the brightness rate of the first, second and third sub-pixels of white, and RLogo, GLogo and BLogo are the data signal value of the first, second and third sub-pixels.

13. The driving method of claim 9, wherein each pixel in the logo area includes first, second and third sub-pixels, and wherein the first and second data signals are applied when the first brightness is equal to or less than a predetermined maximum brightness and the first data signal of each of first, second and third sub-pixels is equal to or less than a maximum gray level.

14. The driving method of claim 13, wherein a gray level of the first data signal is decreased and a gray level of the second data signal is increased when the first brightness is more than the maximum brightness or the first data signal of at least one of the first, second and third sub-pixels is more than the maximum gray level.

15. The driving method of claim 9, further comprising: calculating the second brightness by the following equation:

$$L2=(Lb-(L1*Rn))/(1-Rn)$$

wherein, L2 is the second brightness.

* * * * *